United States Patent [19]

Mikoshiba

[11] Patent Number: 4,683,819

[45] Date of Patent: Aug. 4, 1987

[54] COMPACT PRINTER WITH HAMMER STRUCTURE WITHIN TYPE DRUM

[75] Inventor: Hitoshi Mikoshiba, Shiojiri, Japan

[73] Assignee: Seiko Epson Kabushiki Kaisha, Tokyo, Japan

[21] Appl. No.: 748,893

[22] Filed: Jun. 26, 1985

[30] Foreign Application Priority Data

Jun. 28, 1984 [JP] Japan ..... 59-133806
Jun. 28, 1984 [JP] Japan ..... 59-133807

[51] Int. Cl.[4] ..... B41J 9/02
[52] U.S. Cl. ..... 101/93.22; 400/152
[58] Field of Search ..... 101/93.13, 93.18, 93.22, 101/93.24, 93.28; 400/152

[56] References Cited

U.S. PATENT DOCUMENTS

| | | | |
|---|---|---|---|
| 757,377 | 4/1904 | White | 400/152 X |
| 3,349,702 | 10/1967 | Nesin et al. | 101/416 R |
| 4,244,290 | 1/1981 | Tamai et al. | 101/93.22 X |
| 4,358,694 | 11/1982 | Grundland | 101/93.22 X |
| 4,416,557 | 11/1983 | Arai | 400/152 |
| 4,458,589 | 7/1984 | Watanabe et al. | 101/93.23 |
| 4,484,520 | 11/1984 | Kimura et al. | 101/93.22 X |

FOREIGN PATENT DOCUMENTS 56-63471 5/1981 Japan .

*Primary Examiner*—Edgar S. Burr
*Assistant Examiner*—Tonya Lamb
*Attorney, Agent, or Firm*—Blum Kaplan

[57] ABSTRACT

A compact printer having a cylindrical support member and a type carrier member externally affixed to the support member. A type printing assembly is disposed within the type drum for causing characters on the type carrier member to print. A motor for rotating the type drum is connected directly to the drum and disposed immediately adjacent to the type drum with axes of rotation being colinear. A paper feed drive for feeding paper one time per revolution of the type drum includes an intermittent tooth on an end of the support member, a feed gear for being turned by engagement with the intermittent gear, and a paper feed roller driven by the feed gear to feed paper to be printed on. A generating means including a cam on the type drum, positively generates an output indicative of a given position of the type drum.

15 Claims, 3 Drawing Figures

COMPACT PRINTER WITH HAMMER STRUCTURE WITHIN TYPE DRUM

BACKGROUND OF THE INVENTION

The present invention relates to compact or miniprinters, and more particularly to printer assemblies to be incorporated in apparatus such as electronic calculators and the like.

In conventional compact printers or miniprinters, such as that disclosed in the specification of Japanese Patent Laid Open Number 56-63471, or U.S. Pat. No. 4,458,589, a drum is driven by a stepper motor through a gear train. One or more types are selectively struck from inside the type drum to perform printing. The mechanism carries out printing by selectively suspending movement of the types.

A difficulty associated with this conventional design is that even if the stepper motor is stopped, the type drum may still rotate or vibrate because of backlash in the gear train. Thus, the type drum may not come to a standstill at a given position or at the desired time. If typing is performed when such an unstable condition exists, the characters printed in each column may not be uniform and the linearity or alignment of the characters may be poor.

If printing is not executed until the transient motions subside, the printing cycle becomes very long and printing speed is low. In addition, when the vibrations are very large, there is a danger that the proper type will not engage with the hammer, so that mistyping and misplacement of characters may result.

In these conventional arrangements, the motor gear and motor have a shaft separate and apart from that of the type drum. As a result, the printer requires a relatively wide space. The motor gear, the motor and the type drum all require respective shafts and bearings. Thus, many different components are required including separate screws for attaching the motor, and the cost is increasd. These conventional printers require excess energy to drive both the gears and the type drum and therefore a great deal of motor energy is consumed and much noise is generated by the gears.

In addition, in these conventional printers, it is necessary to provide a signal which indicate that the type drum is in a standard or "home" position in order to properly synchronize the printing with the position of the drum. If this signal is not maintained in its proper "phase" with respect to rotation of the drum due to backlash or wear, then mistyping will result. Further, discrepancies in timing between paper feed and motor rotation or play in a power transmission section of a paper feed mechanism in a conventional printer can cause the extremely serious difficulty of paper feed during typing.

Accordingly, it is desirable to provide a compact or miniprinter which can be incorporated into a portable electronic device which overcomes these shortcomings of the prior art devices.

SUMMARY OF THE INVENTION

Generally speaking, in accordance with the invention, a compact printer having a substantially cylindrical member or type drum which may include a cylindrical support frame and a type member wound around and externally affixed to the support frame is provided. Type printing means are disposed within the cylindrical member for selectively causing characters on the cylindrical member to print on a sheet of paper in the printer. A motor means, such as a stepper motor, for rotating the cylindrical member is connected directly to the cylindrical member; that is the cylindrical member or drum has an integral portion for engagement directly with the stepper motor. The motor is located immediately adjacent to the cylindrical member.

A yoke for supporting the printing means has a first portion which extends through the type drum. A second portion of the yoke extends past an end of the drum. The motor is disposed around this second portion of the yoke.

The compact or miniprinter according to the invention has a paper feed drive means which includes an intermittent tooth affixed to the cylindrical member or type drum or more particularly on an end of the cylindrical support frame of the type drum. A feed gear for being turned by engagement with the intermittent gear drives a paper feed roller to incrementally feed paper to be printed on. The paper is fed one increment per revolution of the type drum.

The compact or miniprinter of the present invention also includes a generating means for providing an output indicative of a given position of the type drum. A cam surface on the cylindrical support frame and a sensing member for sensing variation in height of the cam surface provide this output.

According to the present invention, a rotating portion of the motor and the type drum are coupled by the interaction of corresponding grooves and projections in the rotating portion and in the type drum.

Accordingly, it is an object of the invention to provide a miniprinter of high reliability and printing quality.

Another object of the invention is to provide a miniprinter which greatly reduces the chances of mistyping or misalignment of the type.

It is another object of the invention to provide a miniprinter which is small in size, low in cost, low in energy consumption and produces little noise when printing.

It is another object of the invention to provide a miniprinter which precisely and accurately provides an output indicative of the rotational position of the type drum so that paper is fed at the proper time in the print cycle and so that printing operations are accurately performed.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a full understanding of the invention, reference is had to the following description taken in connection with the accompanying drawings, in which.

DETAILED DESCRIPTION OF THE PREFERRED EMBODIMENT

Figure 1:
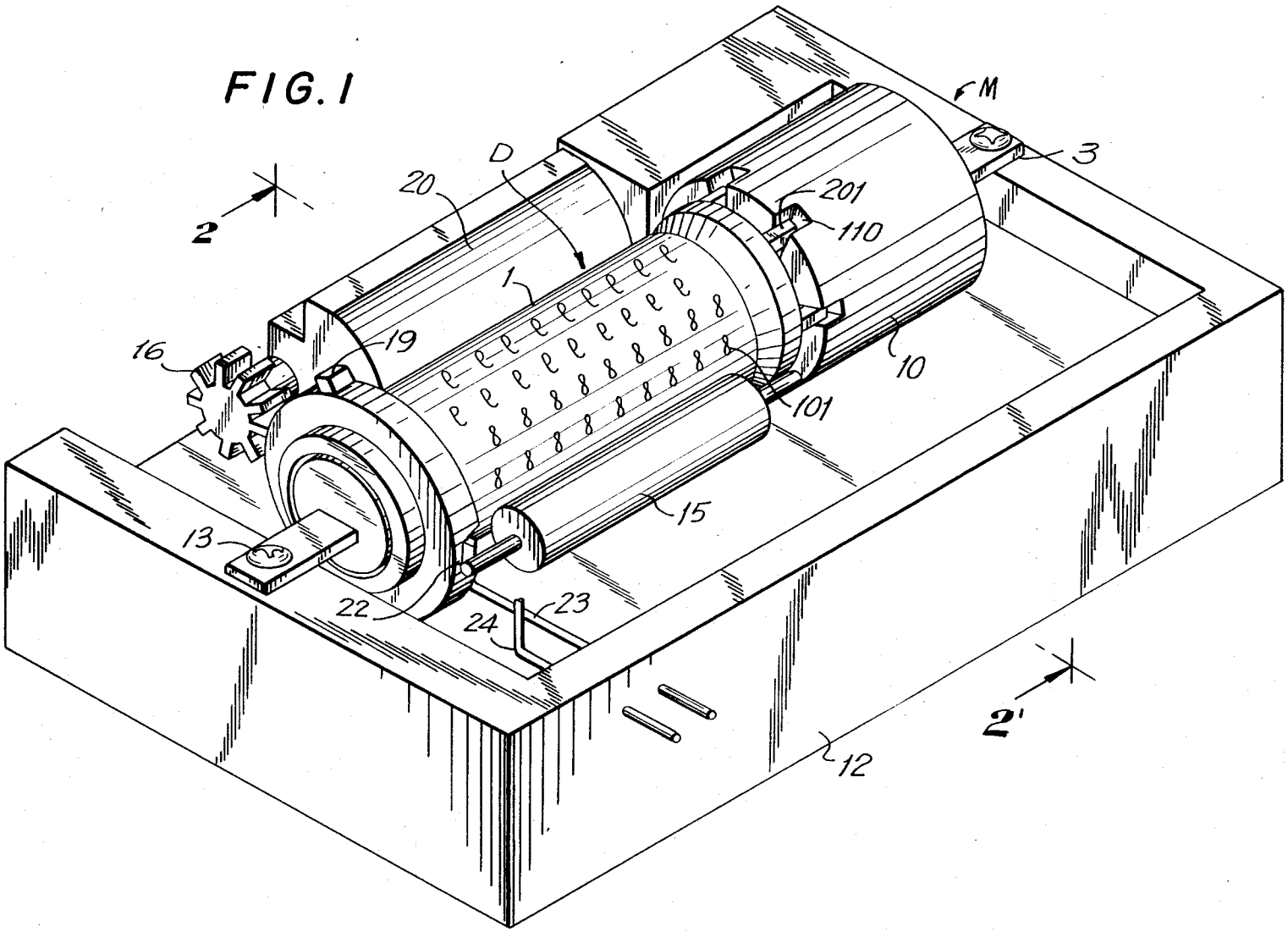
FIG. 1 is a perspective view of a miniprinter constructed in accordance with an embodiment of the invention.
Figure 2:
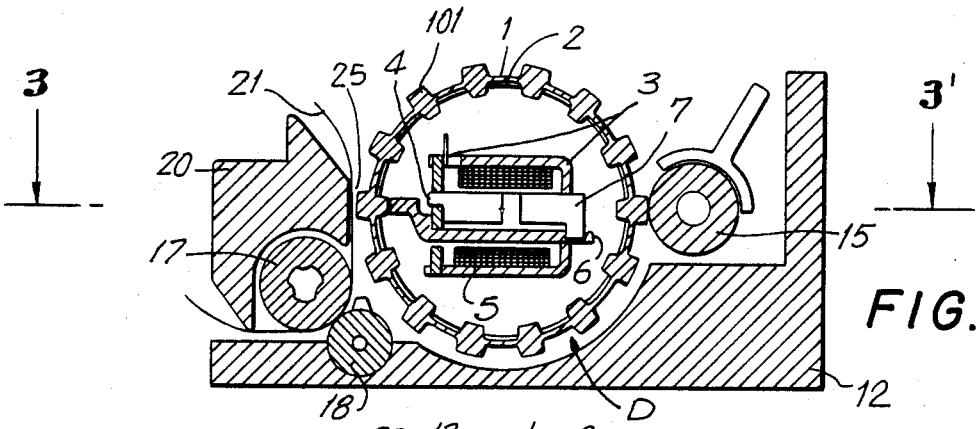
FIG. 2 is a sectional end view of the miniprinter shown in FIG. 1 taken along line 2—2' of FIG. 1.
Figure 3:
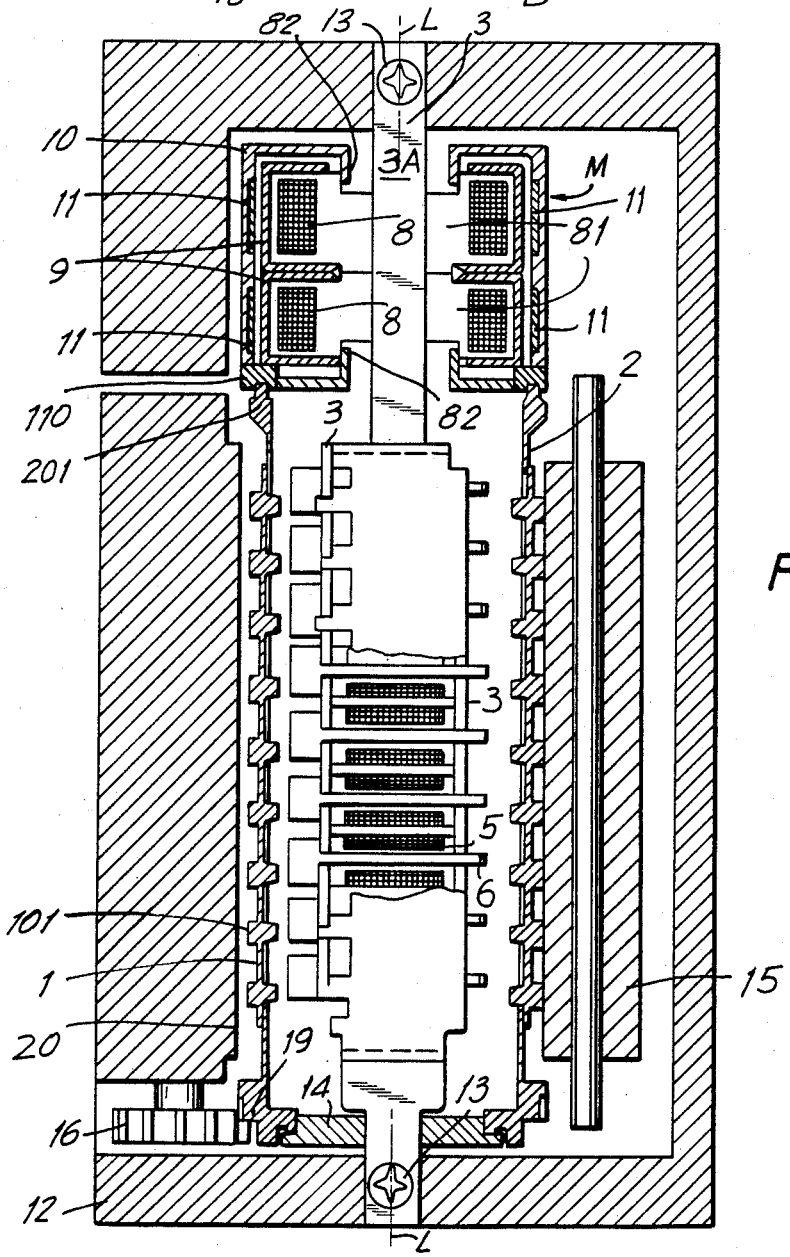
FIG. 3 is a partially cut away sectional plan view of the miniprinter shown in FIG. 1, taken along line 3—3' of FIG. 2.

Reference is made to FIGS. 1 through 3 in which a type sheet 1 generally made of a somewhat flexible resilient material and having type characters 101 on its surface is wound around and affixed to a type sheet receiver or cylindrical support frame 2. Type sheet 1 and cylindrical support frame 2 together make up a type drum D.

An electromagnetic yoke 3 has a first portion which extends through cylindrical support frame 2 of type drum D and a second portion 3A extending substantially past the end of drum D. Yoke 3 is mounted to a printer frame 12 by means of two screws 13, one located at each end of yoke 3.

An iron core 4 is fixed to electromagnet yoke 3. A series of coils 5 are wound around iron core 4. A hammer 6 is slidably mounted within each coil 5. An attraction plate 7 is positioned inside each coil 5. Attraction plates 7 are movable substantially in unison with their respective hammers 6. Attraction plates 7 are driven so as to approach iron core 4 due to electromagnet forces of attraction when a current is caused the flow through a respective coil 5. When a desired type member 101 is in a print position 25 and coil 5 of a desired column is activated, corresponding hammer 6 strikes type member 101 and a character is typed on a print paper 21. Type sheet 1 resilently returns to its normal shape on support frame 2 after a character is printed causing hammers 6 and corresponding attraction plates 7 to return to their corresponding non-printing or "rest" positions after a character is printed.

A motor, show generally at M, having a motor coil 8 is wound on a coil frame portion 81 which is a lateral extension of second portion 3A of yoke 3. This is the portion of yoke 3 which extends outside of and substantially past an end of cylindrical support frame 2. A fixed stator 9 is provided to cover the outside of motor coil 8. A motor rotor 10 having magnets 11 is rotatably supported by a first bearing section 82 provided on coil frame portion 81 of motor coil 8. The motor is designed so that there is a slight gap between magnets 11 and stator 9. The combination of motor coil 8, stator 9 and rotor 10 is generally called an outer-rotor stepper motor.

Rotor 10 and type sheet receiver or cylindrical support frame 2 are mutually and directly coupled by means of four grooves 110 on rotor 10 and four projections 201 on support member 2. Accordingly, as rotor 10 rotates cylindrical support frame 2 is simultaneously driven.

A second bearing 14 secured to cylindrical support frame 2 at the end opposite to motor M, rotatably supports cylindrical support frame 2 about yoke 3. Bearing section 82 provides support at the opposite end of cylindrical support frame 2. As cylindrical support frame 2 is rotated by stepper motor M, an ink roller 15 provides ink to type characters 101.

Print paper 21 is fed past a platen 20 between a paper feed roller 17 and a paper pinch roller 18. Paper feed roller 17 is driven by a paper feed gear 16 which engages with an intermittent tooth 19 provided on cylindrical support frame 2.

A cam surface 22 is provided on the end of cylindrical support frame 2 opposite motor M. A first detection spring 23 and a second detection spring 24 are mounted on printer frame 12 so as to be in contact with cam surface 22. Detection springs 23 and 24 move in response to motion of cam surface 22 to each provide a reset signal for every one revolution of cylindrical support frame 2. Detection springs 23 and 24 may each operate an appropriate mechanical switch (not shown) so that each switch generates a pulse when its respective detection spring 23 and 24 is caused to move by cam surface 22. The timing of these pulses is related to and indicative of the rotational position of type drum D.

Stepper motor M may be powered by circuits which are well known in the art and do not form a part of the present invention. A block diagram of such a circuit is shown, for example, in the above mentioned U.S. Pat. No. 4,458,589.

When a desired type number 101 arrives at print position 25, the power supply is controlled so as to stop rotor 10. Coil 5 of a desired column is powered to drive corresponding hammer 6. Type member 101 is struck from its backside to type a character on the print paper 21 as noted above. After a similar print operation is performed with respect to all columns and as rotor 10 nears the end of a full revolution, intermittent tooth 19 comes into engagement with paper feed gear 16 and print paper 21 is fed one pitch as a result of rotation of paper feed roller 17, thereby completing the printing process for one line.

Synchronization between the selected print character and the driving signal of motor M is achieved by a reset signal which is generated once for every revolution of the cylindirical support frame 2 by means of cam surface 22. When rotor 10 stops to allow printing, cylindrical support frame 2 is also immediately stopped. Thus, even if printing is carried out at the same time that rotation of motor M is halted, the alignment of the printed character is excellent because the desired type member is at the proper position. The printing cycle can be increased in speed because instant printing is permitted. Further, since rotor 10 and cylindrical support frame 2 move in unison, support frame 2 does not vibrate when rotor 10 is stopped, thus completely avoiding mistyping and misalignment.

A printer constructed in accordance with the invention presents advantages in addition to high speed and proper alignment. For example, in a printer of the present invention the number of parts required is reduced. This is because bearing 82 is combined with coil frame 81 of motor coil 8. Further, one end of cylindrical support frame 2 is supported by bearing 82 of motor M. Thus, the parts required for the motor drive transmission mechanism are produced at low cost. Further, costs are reduced in that motor M is fixed by yoke 3 which serves two purposes, one being supporting the type members and the other supporting stator 9 of motor M. The elimination of gears to drive the type drum also reduces power consumption. Clashing sounds or noises of the type generally associated with gears, especially at the time of step feeding of paper, are eliminated. Thus, the printer of the present invention produces very low noise levels when printing.

The printers constructed and arranged in accordance with the invention are also reduced in size in the front to rear direction. This is a direct result of positioning the motor and the cylindrical support member of the type drum substantilly in one line along axis L. Such a structure is extremely useful in electronic calculators which can be miniaturized to a greater extent if a printer arranged in accordance with the invention is used therein.

A printer in accordance with the invention does not produce mistyping and misalignment of print because motor M and cam 22, used for generation of reset signals, operate substantially as one unit. The reset signal is precisely and reproducibly generated, in time with respect to the signal for driving the motor. Further, the timing of paper feed is precise and the paper is fed at the correct timing position because paper feed intermittent tooth 19 and motor M operate substantially as one unit. Additionally, intermittent tooth 19 is directly engaged with the paper feed gear 16 of paper feed roller 17. Thus, characters are not lost at the beginning or end of a print cycle.

In summary, as is apparent from the foregoing description, the present invention provides a compact or miniprinter which includes a cylindrical support member and a type member wound around and affixed to the support member to form a type drum. The rotor section of a stepper motor is coupled directly to the drum. The rotational axes of the rotor and the drum are colinear. The stepper motor is provided on an extension of the yoke which supports the type printing means. The type printing means is positioned inside the drum. Therefore, a gear transmission section is unnecessary and backlash is eliminated. Printing quality and speed are excellent and problems such as missing or erroneous printed characters are avoided. Further, the printer of the present invention can be miniaturized and has low power consumption. The noise level during printing is extremely low since no gear train is present to cause noise and vibration. Finally, the present invention provides a printer which is low in cost because the number of parts such as bearings and shaft is greatly reduced.

The present invention provides a reliable miniprinter which includes a positive paper feed drive means and a cam for generating pulses reliably at a given position of the type drum. This eliminates the possibility of mismatch in operational phases and eliminates the possibility of mistyping that results from deviation in the timing of the pulses. It further eliminates the possibility of printing characters off line which results from paper feed motion during the printing which in turn may result from shifts in the timing of the paper feed.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A compact printer comprising:

a frame;

a substantially cylindrical member having a plurality of type characters disposed on the surface of said member;

type printing means disposed within said cylindrical member for selectively causing characters on said cylindrical member to print; and an elongated yoke mounted on the frame having a first portion extending through the cylindrical member and a second portion extending past an end of the cylindrical member, the cylindrical member mounted on the first portion, motor means for rotating said cylindrical member mounted on the second portion of the yoke, said motor means being directly coupled to said cylindrical member so that said cylindrical member rotates in unison with said motor means, said motor means being coaxial with and adjacent to said cylindrical member.

2. The compact printer of claim 1, further comprising paper feed drive means for incrementally feeding a print paper one increment per revolution of said cylindrical member.

3. The compact printer of claim 2, wherein said paper feed drive means comprises:

an intermittent tooth formed on said cylindrical member;

a feed gear operatively engaged by said intermittent gear; and a paper feed roller driven by said feed gear to advance said print paper.

4. The compact printer of claim 1, further comprising generating means for generating an output signal indicative of a given position of said cylindrical member.

5. The compact printer of claim 4, wherein the generating means comprises a cam surface on said cylindrical member; and a sensing member operatively coupled to said cam surface for sensing a variation in height of said cam, said variation in height being associated with said given position of said cylindrical member.

6. The compact printer of claim 5, further comprising a second sensing member for generating an additional output indicative of said given position of said cylindrical member.

7. The compact printer of claim 1, further comprising a rotating portion of the motor means having projections integrally formed on the cylindrical member, and grooves are integrally formed in said rotating portion of the motor means, the projections cooperating with the grooves for rotating the cylindrical member in response to rotation of the rotating portion of the motor means.

8. The compact printer of claim 1, wherein said motor means is a stepper motor.

9. The compact printer of claim 1, wherein said motor means is of the outer-rotor type.

10. The compact printer of claim 1, wherein said type characters are formed on a flexible, resilient sheet.

11. The compact printer of claim 1, wherein said type printing means comprises:

a plurality of electromagnets;

a respective attraction plate for each electromagnet for being attracted by its corresponding electromagnet;

a respective hammer for each respective attraction plate for being actuated by motion of its respective attraction plate when its corresponding electromagnet is actuated, each hammer being for striking selected types of said type member; and a yoke extending through said cylindrical member for supporting said electromagnets.

12. The compact printer of claim 1, further including a common bearing at a first end of said cylindrical member for rotatably supporting the motor means and cylindrical member.

13. The compact printer of claim 12 further comprising an additional bearing for rotatably supporting said cylindrical member at a second end of said cylindrical member.

14. The compact printer of claim 1, wherein said cylindrical member is a type drum.

15. A compact printer comprising:

a frame;

a type drum rotatably mounted within the frame;

a type member having a surface on which types are distributed;

an elongated yoke mounted on the frame having a first portion extending through the cylindrical member and a second portion extending past an end of the cylindrical member, the cylindrical member mounted on the first portion, a printing electromagnet assembly, disposed within the type drum, including a plurality of electromagnets, a respective attraction plate for each electromagnet for being attracted by its corresponding electromagnet and respective hammer for each respective attraction plate for being actuated by motion of its respective attraction plate when its corresponding electromagnet is actuated, each hammer being for striking selected types of said type member from the inside of said type drum to perform printing;

a stepper motor for driving said type drum, said stepper motor mounted on the second position of the yoke and being coaxial with and adjacent to said type drum and being directly coupled with each other so that said cylindrical member rotates in unison with said type drum;

a paper feed drive means, cooperatively engaged with the type drum so that said paper drive means is driven by the type drum, for incrementally feeding a print paper one increment per revolution of said type drum; and a detection means mounted in the frame for detecting the position of the type drum; and a cam surface integrally formed on the type drum cooperating with said detection means.

* * * * *